US007584592B2

(12) United States Patent
Gabrielson et al.

(10) Patent No.: US 7,584,592 B2
(45) Date of Patent: Sep. 8, 2009

(54) PACKAGING SYSTEM AND METHOD

(75) Inventors: David M. Gabrielson, Chagrin Falls, OH (US); Robert C. Cheich, Independence, OH (US); Joseph J. Harding, Mentor, OH (US); Daniel L. Carlson, Ravenna, OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 11/573,186

(22) PCT Filed: Aug. 4, 2005

(86) PCT No.: PCT/US2005/027624

§ 371 (c)(1),
(2), (4) Date: Feb. 2, 2007

(87) PCT Pub. No.: WO2006/017602

PCT Pub. Date: Feb. 16, 2006

(65) Prior Publication Data

US 2008/0092488 A1 Apr. 24, 2008

Related U.S. Application Data

(60) Provisional application No. 60/669,713, filed on Apr. 7, 2005, provisional application No. 60/655,645, filed on Feb. 22, 2005, provisional application No. 60/644,736, filed on Jan. 18, 2005, provisional application No. 60/598,689, filed on Aug. 4, 2004.

(51) Int. Cl.
*B65B 23/00* (2006.01)
*B65B 61/20* (2006.01)

(52) U.S. Cl. ..... 53/445; 53/472; 53/474; 53/52; 53/503; 53/505; 53/155; 53/238; 53/240; 493/464; 493/967

(58) Field of Classification Search ..... 53/396, 53/445, 472, 474, 155, 237, 238, 240, 503–506, 53/52, 202; 493/464, 967
See application file for complete search history.

(56) References Cited

U.S. PATENT DOCUMENTS 3,651,465 A * 3/1972 Law et al. ..... 340/5.8
4,922,687 A * 5/1990 Chow et al. ..... 53/472
4,938,007 A * 7/1990 Sperry ..... 53/472

(Continued)

FOREIGN PATENT DOCUMENTS

DE 19813311 A1 10/1998

(Continued)

OTHER PUBLICATIONS

International Search Report for PCT/US2005/027624.

*Primary Examiner*—Stephen F Gerrity
(74) *Attorney, Agent, or Firm*—Renner, Otto, Boisselle & Sklar, LLP

(57) ABSTRACT

An automated packaging system has a plurality of dunnage dispensing stations that can dispense dunnage and a transport network for conveying containers to and from at least two dispensing stations for dunnage to be placed therein. At at least one loading station upstream of a dispensing station articles are placed in the containers for shipping. Optionally, an intermediate void determination station determines how much dunnage to dispense.

20 Claims, 7 Drawing Sheets

U.S. PATENT DOCUMENTS

| | | | | |
|---|---|---|---|---|
| 5,406,770 | A * | 4/1995 | Fikacek | 53/155 |
| 5,720,157 | A * | 2/1998 | Ross | 53/445 |
| 5,778,631 | A | 7/1998 | Simmons et al. | |
| 5,829,231 | A | 11/1998 | Harding et al. | |
| 5,871,429 | A * | 2/1999 | Harding et al. | 53/472 |
| 5,876,318 | A * | 3/1999 | Ratzel | 493/30 |
| 2001/0017023 | A1 | 8/2001 | Armington et al. | |
| 2002/0007618 | A1 | 1/2002 | Armington et al. | |
| 2003/0083890 | A1 * | 5/2003 | Duncan et al. | 705/1 |
| 2007/0157558 | A1 * | 7/2007 | Mertz et al. | 53/472 |

FOREIGN PATENT DOCUMENTS

| | | | |
|---|---|---|---|
| WO | 2004041653 | A | 5/2004 |

* cited by examiner

PACKAGING SYSTEM AND METHOD

This invention claims the benefit of the filing dates of the following international patent application and U.S. provisional patent applications: International Patent Application No. PCT/US2005/027624, filed Aug. 4, 2005; U.S. Provisional Application No. 60/669,713, filed Apr. 7, 2005; U.S. Provisional Application No. 60/655,645, filed Feb. 22, 2005; U.S. Provisional Application No. 60/644,736 filed Jan. 18, 2005; and U.S. Provisional Application No. 60/598,689, filed Aug. 4, 2004, all of which are hereby incorporated herein by reference.

FIELD OF THE INVENTION

This invention relates generally to a packaging system for providing a quantity of dunnage material for insertion into containers in which one or more articles are to be packed for shipping.

BACKGROUND

In a typical application, a packer pulls articles itemized on a list of articles to be shipped and places them in a container. Before shipping the articles, a protective packaging material or other type of dunnage is placed around the article in the container. The dunnage material fills at least a portion of any voids and/or cushions the article during shipment to prevent or minimize movement of the article relative to the container and/or prevent or minimize damage to the article during transport. Some commonly used dunnage materials are plastic foam peanuts, plastic bubble pack, air bags and crumpled paper material.

An operator of a dunnage dispenser observes the container as it is being filled with dunnage material and stops the dispenser when the container appears to be full. The container is then closed for shipment. Some exemplary dispensers include: plastic peanut dispensers, which are often associated with an air delivery system; foam-in-place dispensers, air bag machines and paper dunnage converters.

Oftentimes a dispenser operator overfills the container with the result that more dunnage material is placed in the container than was needed to adequately protect the article and/or fill the void in the container. In other instances, the operator puts too little dunnage material in the container, whereupon the article has more room to move in the container and/or can be damaged during shipment.

Over-filling and under-filling typically become more of a problem as the speed of the dispensing operation increases. Today, void-fill dispensers, in particular paper dunnage converters, can deliver a strip of dunnage material at rates in excess of fifty feet per minute (about one-quarter of a meter per second).

SUMMARY

A system and methodology for automating a void-filling packaging operation is provided. An embodiment provides a packaging system that includes a plurality of dunnage dispensing stations, each of which has at least one dunnage dispenser from which a dunnage material can be dispensed, and a transport network for conveying containers to and from at least two dunnage dispensing stations for dunnage to be placed therein. The dispensing stations can be arranged along a portion of the transport network such that one or more containers can be conveyed to multiple dispensing stations sequentially in series and/or in parallel. The system can also include a supply of dunnage that can be dispensed at at least one dunnage dispensing station. The supply can include a dunnage conversion machine that can convert a stock material into a relatively less dense dunnage material and supply it to one or more dunnage dispensing stations. The supply of dunnage can include, for example, one of air bags, crumpled paper, foam strips, foam peanuts, and paper strips.

The system also can include a controller for controlling one or more elements of the system. These elements can include, for example, one or more loading stations where one or more articles are placed in one or more containers for transport, one or more intermediate stations upstream of at least one dunnage dispensing station that includes a void sensor for sensing a characteristic of the void volume in the container, and/or one or more devices, such as sensors, for determining whether the container conforms to predetermined criteria. In the latter instance, a transport network can also include a way to divert nonconforming containers that fail to meet the predetermined criteria.

A packaging method provided herein includes routing the container to a dunnage dispensing station selected from a plurality of dunnage dispensing stations based on routing criteria and supplying dunnage to a container at a dunnage dispensing station. The routing criteria can include, for example, the availability of dunnage dispensing stations, characteristics of the dunnage material, characteristics of the container, characteristics of the void in the container, and/or characteristics of the article to be shipped in the container. Supplying dunnage can include, for example, determining the void volume in the container.

In an embodiment, a method also includes assigning an identifier to each container and tracking the container as it moves through the packaging system.

An embodiment provides a system and method characterized by one or more void sensing stations that sense characteristics of a void volume of a container, one or more dunnage dispensing stations that can dispense dunnage material based on the sensed characteristics of the void sensing stations, and a transport network for conveying the container from one of the void sensing stations to a selected one or more of the dunnage dispensing stations.

Optionally, an embodiment of a packaging system includes at least one sensor that senses at least one characteristic of a container, and a controller that determines whether the container is suitable for placing dunnage material therein based on the sensed characteristic of the container. A packaging system can include one or more dunnage dispensing stations where dunnage is dispensed for insertion in a void in a container, with at least one dunnage dispensing station being capable of dispensing multiple types of dunnage material.

Another embodiment of a packaging method can include the following steps: routing the container to a dunnage dispensing station selected from a plurality of dunnage dispensing stations based on routing criteria, and supplying dunnage to a container at a dunnage dispensing station.

Optionally, the the routing step can include routing based on routing criteria that includes one or more of characteristics of the dunnage material, characteristics of the container, characteristics of the void in the container, and characteristics of the article to be shipped in the container.

An embodiment of the invention can include one or more of the following steps: determining the type of dunnage dispensed, controlling the quantity of dunnage dispensed, measuring characteristics of the container, and consulting a database to determine the void volume.

In another embodiment of the invention, a packaging system includes one or more void sensing stations that sense characteristics of a void volume of a container; a plurality of dunnage dispensing stations that can dispense dunnage material based on the sensed characteristics of the void sensing stations; and a transport network for moving the container from one of the void sensing stations to a selected one of the dunnage dispensing stations.

In an embodiment of the invention, a packaging method includes determining a void volume of a container, conveying the container to a selected one of a plurality of dunnage dispensing stations, and dispensing dunnage material based on the void volume of the container.

In an embodiment of the invention, a packaging system includes a sensor that senses a characteristic of a container, and a controller that determines whether the container is suitable for placing dunnage material therein based on the sensed characteristic of the container.

In another embodiment of the invention a packaging method includes sensing at least one characteristic of a container; and determining whether the container is suitable for placing dunnage material therein based on the sensed characteristic.

In an embodiment of the invention, a packaging system includes a plurality of dunnage dispensing stations where dunnage is dispensed to place in a void in a container, at least one dunnage dispensing station being capable of dispensing multiple types of dunnage material.

In an embodiment of the invention, an automated packaging system for filling the void in a container includes a plurality of loading stations for loading containers, a plurality of dunnage dispensing stations, a transport network linking the loading station to the plurality of dunnage dispensing stations for transporting the containers from the plurality of loading stations to one or more dunnage dispensing station, and a controller. The controller automatically routes containers via the transport network to selected dunnage dispensing stations.

Optionally, the system can include one or more of: a void volume detection device upstream of at least one dispensing station for obtaining information indicative of the void volume in the container and providing the obtained information to the controller; a controller that determines a volume of dunnage to be dispensed at a dunnage dispensing station as a function of the information indicative of the void volume and directs a dunnage dispensing station to automatically dispense the determined volume of dunnage; a void volume detection device that includes a sensor that obtains measurements of the container; and a void volume detection device that includes a sensor that obtains data indicative of the topography of the contents of the container; wherein the data indicative of the void volume is obtained from one of a bar code, an RFID chip, and data stored in a database.

In an embodiment of the invention an automated system for packaging articles in a container includes a loading station for loading one or more articles in a container; means for identifying a characteristic of the container; means for determining a volume of dunnage to dispense into the container; a plurality of dunnage dispensers; and means for routing the container from the loading station to a selected one of the plurality of dunnage dispensers. The selected dunnage dispenser provides the determined volume of dunnage into the container.

Optionally, the system can include means for determining that the container is not suitable for automatic filling of dunnage as a function of the identified characteristic; and/or one or more dunnage dispensers that include one or more dunnage converters that convert a stock material into a dunnage product.

In accordance with an embodiment of the invention, an automatic packaging system includes a loading station for loading a container; a sensor for obtaining a characteristic of the loaded container; a dunnage dispensing station for automatically placing dunnage in the container; a transport network for moving the container from the loading station to the dunnage dispensing station; and a controller for determining as a function of the obtained characteristic whether to place dunnage in the loaded container.

Optionally, whether to place dunnage in the loaded container is a function of whether the container conforms to a predetermined criteria; and/or the transport network comprises a container diverter to divert a non-conforming container; and/or the container diverter comprises a mechanism to remove the container from the transport network; and/or the container diverter comprises a mechanism to route the container to a manual station.

The foregoing and other features are hereinafter fully described and particularly pointed out in the claims, the following description and the annexed drawings set forth in detail one or more illustrative embodiments of the invention. These embodiments are but a few, however, of the various ways in which the principles of the invention can be employed.

BRIEF DESCRIPTION OF THE APPENDED DRAWINGS

DETAILED DESCRIPTION

Figure 1:
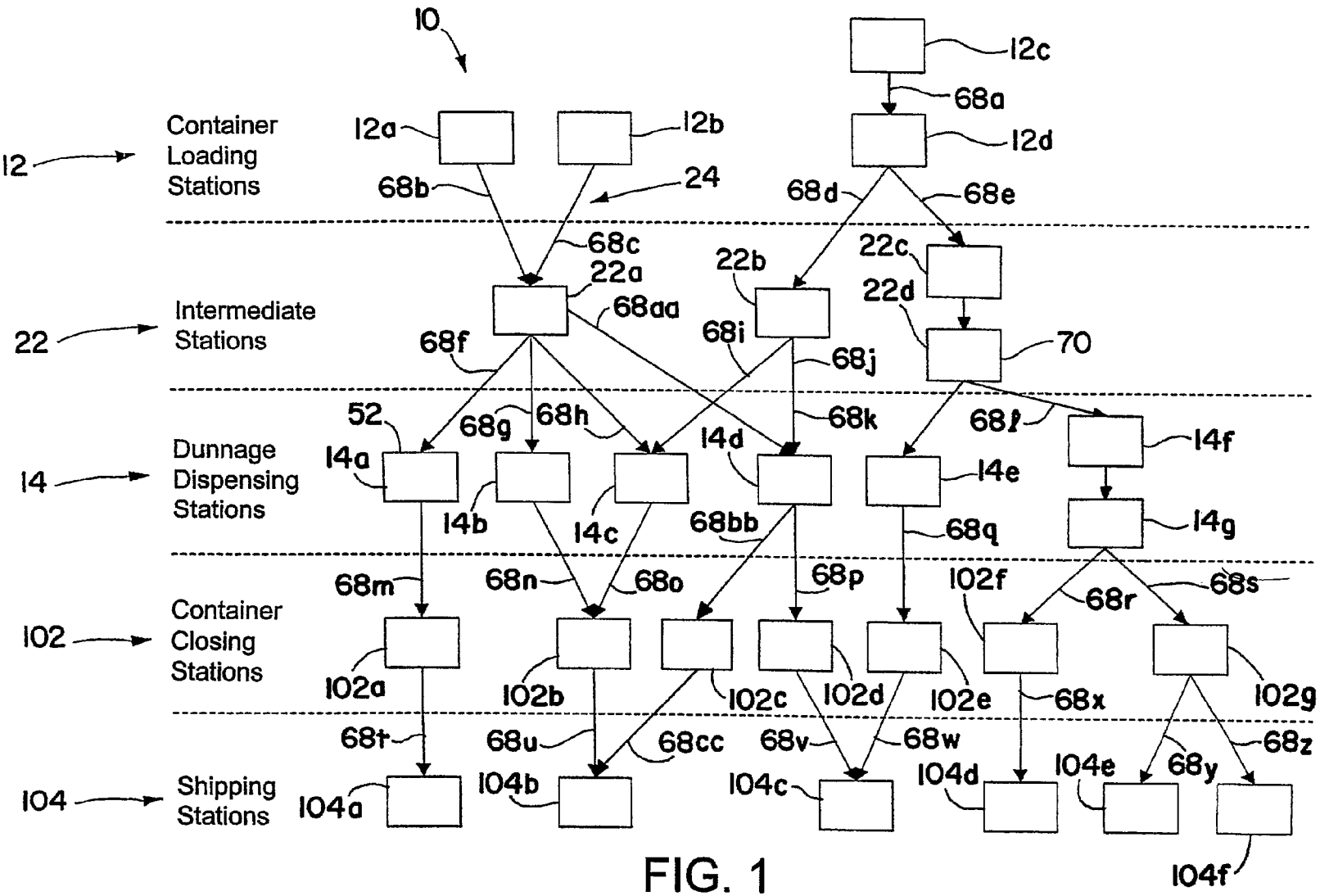
FIG. 1 is a diagrammatic view of a packaging system in accordance with the invention.

Referring now to the drawings, and initially to FIG. 1, an exemplary packaging system in accordance with an embodiment of the invention is indicated generally at 10. The system 10 includes one or more container loading stations 12 such as, for example, loading stations 12*a*, 12*b*, 12*c* and 12*d*, and multiple dunnage dispensing stations 14, such as, for example, dunnage dispensing stations 14*a*, 14*b*, 14*c*, 14*d*, 14*e*, 14*f* and 14*g*. At a loading station 12 one or more articles 16 (FIG. 3) are placed into a container 20. Then at a dunnage dispensing station 14 a dunnage material is dispensed and is placed in the void in the container 20. The void is the space in the container 20 that is not taken up by the one or more articles 16.

The system 10 also can include one or more intermediate stations 22 as may be needed to assist the dunnage dispensing stations 14; a transport network 24 that moves the containers 20 through the stations; and/or a system controller 26 for controlling one or more actions in the system 10, such as controlling the flow of containers 20 through the system 10.

FIG. 1 illustrates a transport network 24 that can route the containers 20 in several different ways through the system 10, such as, for example, from multiple stations to a common station, and from a single station to multiple subsequent stations. Although plural stations of a given type (container loading, intermediate, etc.) are shown in FIG. 1, for a given application only a single station of a given type may be sufficient, and/or no station of a given type may be needed.

Optionally, one or more of the intermediate stations 22 can include a device for determining whether or not the container meets predetermined criteria before receiving dunnage. In addition, optionally one or more of the intermediate stations can include a void determination station or device 30 (FIG. 3) to determine the void volume in the container 20. The void determination device 30 can be used to identify the void volume to calculate the required volume of dunnage to fill the void. The void determination device 30 can also function as a device for determining whether or not the container meets the predetermined criteria.

The embodiment of the system 10 shown in FIG. 1 optionally can include one or more closing stations 102 for closing the container 20, and optionally, the system 10 can include one or more shipping stations 104 for processing the container for shipping.

As will be appreciated, the system 10 can be configured in an embodiment that minimizes or eliminates the need for a packer or other operator, thereby reducing the time required for packing a container and/or increasing the reliability of the packing operation. The system can use, for example, a machine that can dispense and insert the dunnage into the container at a rate faster than that of a packer, thereby reducing the packing time. In addition, the system can be configured, for example, to improve reliability because the correct volume of dunnage can be automatically calculated, thereby reducing or eliminating overfill and underfill problems. The various stations in the illustrated system 10 will be described in further detail with reference to FIGS. 2 and 3, FIG. 2 showing one particular exemplary system 300 and FIG. 3 showing one path a container 20 can follow through the system.

Loading Stations

Figure 2:
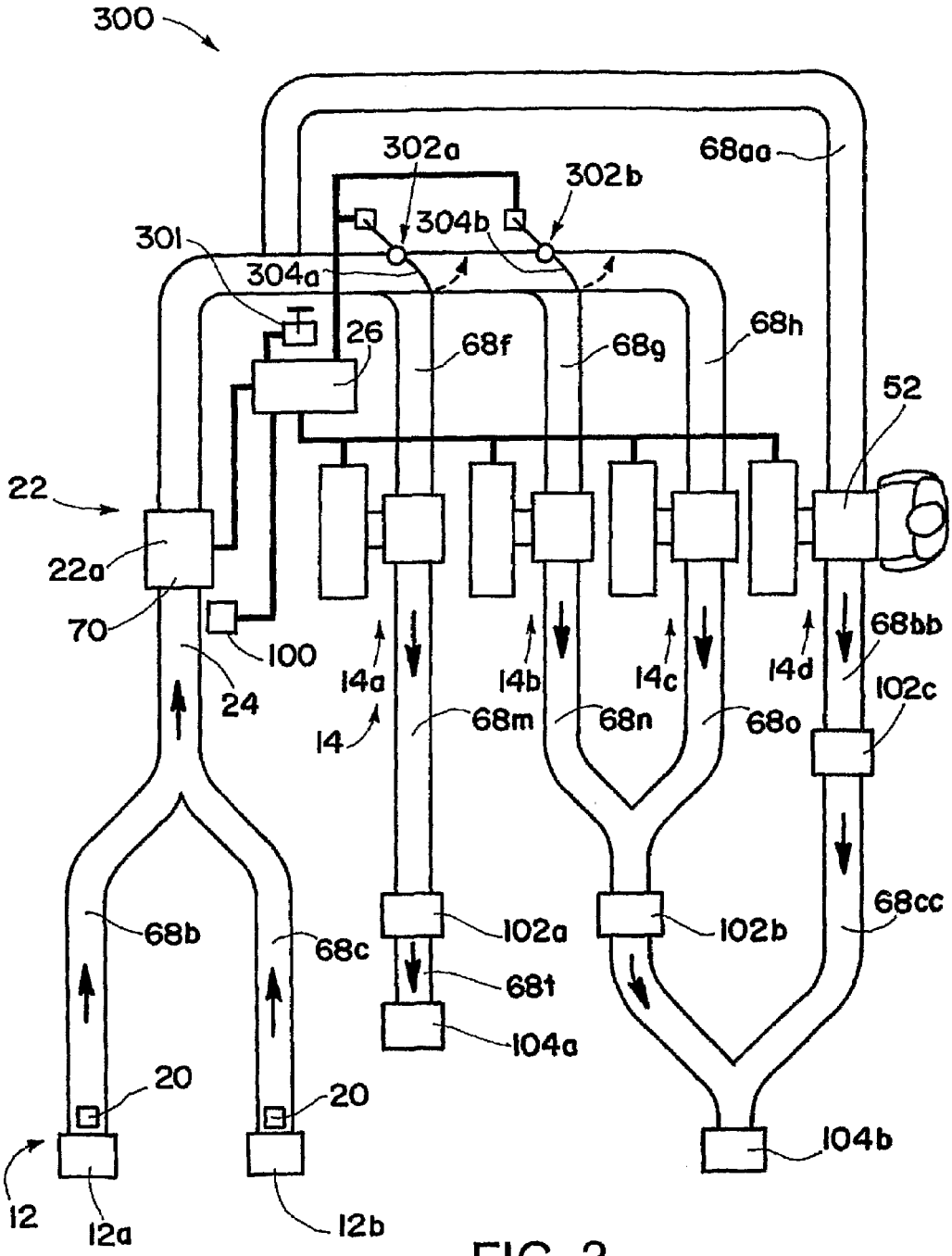
FIG. 2 is a plan view of an embodiment of a packaging system in accordance with the invention.
Figure 3:
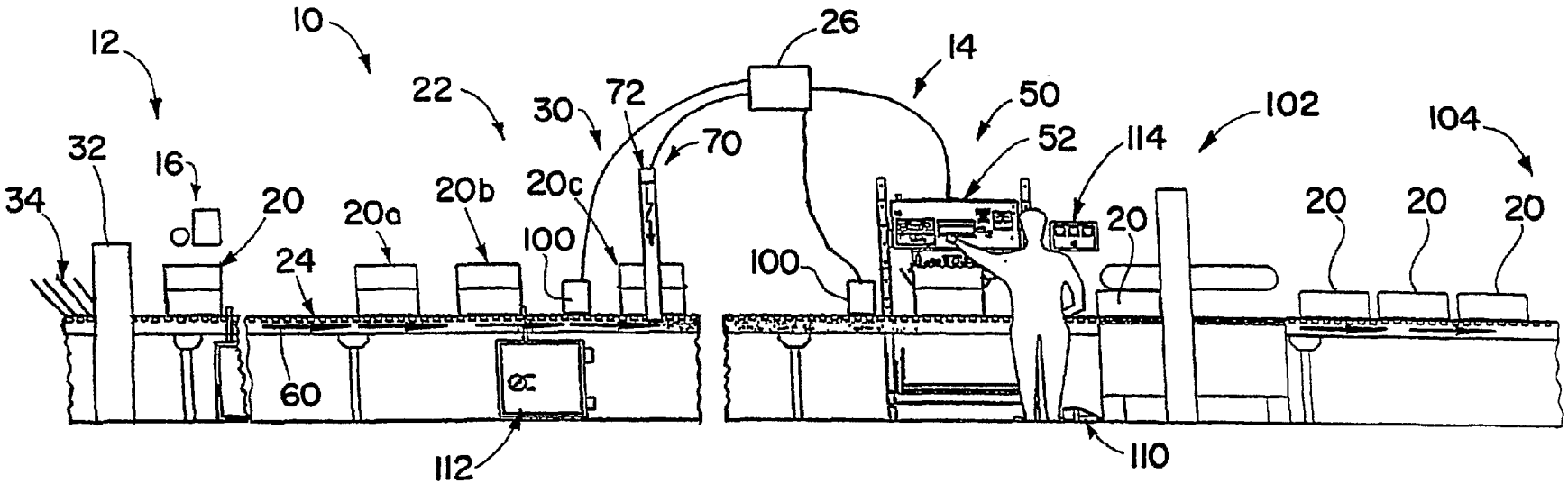
FIG. 3 is a schematic side elevation view of a path a container might take through a packaging system.

As shown in FIGS. 2 and 3, the loading stations 12 can include a box erector 32 for erecting the containers 20, such as cardboard boxes, from flat blanks 34. Other types of containers can be used with this system 10 and a box erector is not required. The box erector can be, for example, a task area at which box blanks are converted into a box by a packer, or an automatic device that automatically converts a box blank into a box. The box erector can even be an apparatus that fabricates the box on site.

An exemplary container 20 is a regular slotted container (RSC), and another type of container is a shoe-box style container. Alternatively, another type of shipping container can be used in this system 10. An RSC typically has four flaps, with one set of opposing flaps typically spanning at least half the distance between them.

Figure 4:
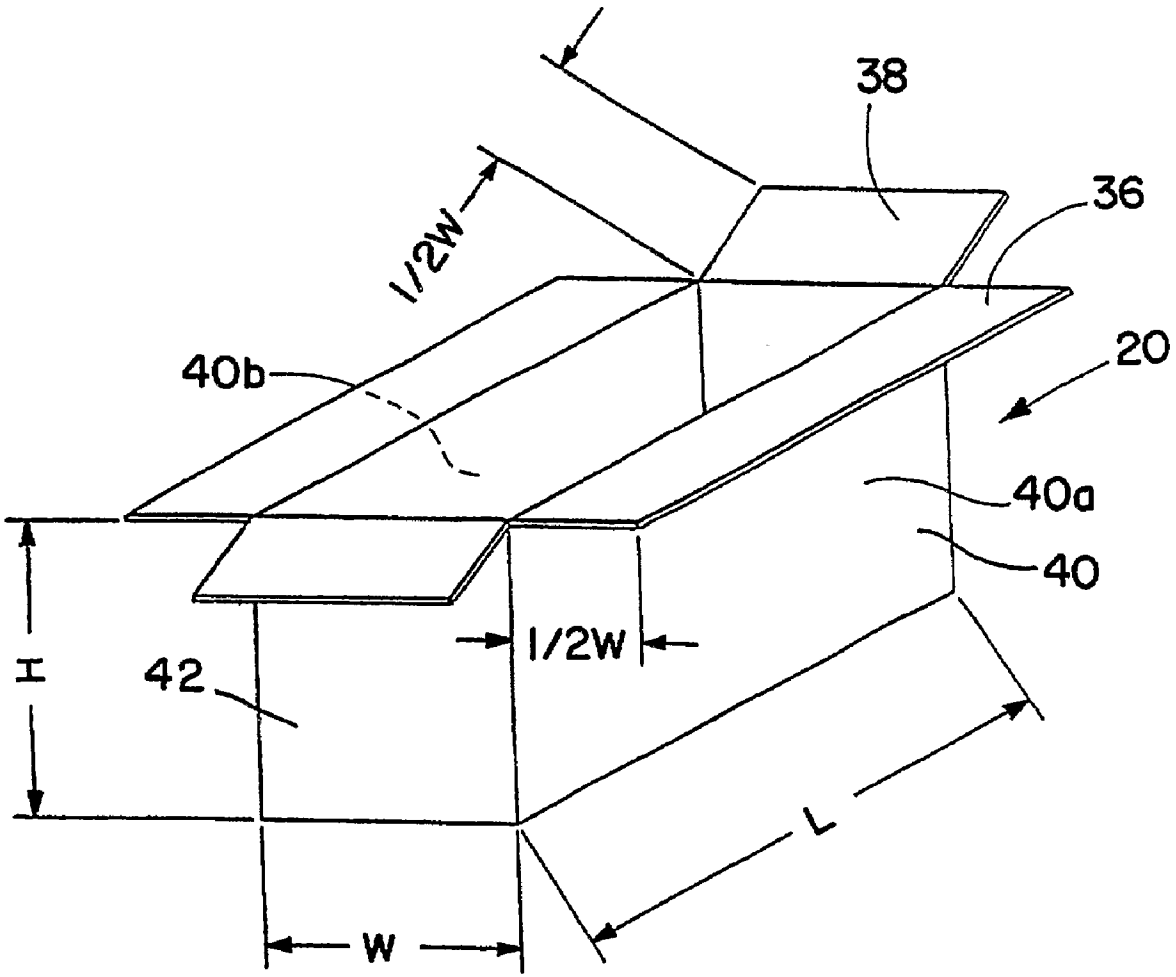
FIG. 4 is a perspective view of a standard regular slotted container (RSC) for use with the system of FIG. 1.

Referring briefly to FIG. 4, an RSC has a specified relationship between the width of the container W and the height of the side flaps 36 and end flaps 38. The flaps 36 and 38 typically have a height that is one half the width W of the container, for example. Accordingly, the height H of the side walls 40 and the end walls 42 of the container 20 (i.e., the height of the container when closed) can be determined from a measure of the height of the container 20 with the flaps 36 and 38 upright in their unfolded state. The height of the side and end walls 40 and 42 (the height of the article-containing portion of the container 20) will be a known fraction of the height of the container when the flaps 36 and 38 are upright and unfolded. Those skilled in the art will appreciate that the height H can be determined in other ways, such as when the flaps 36 and 38 are folded down, which provides a direct measurement of the height of the side and end walls 40 and 42 of the container 20.

Multiple loading stations can be arranged in series so that multiple stations can supply the one or more articles 16 to a container 20 as the container 20 sequentially moves past multiple loading stations. For example and as illustrated in FIG. 1, a first article or articles can be placed in a container at a first station 12*c*, and then the container can be transported to a second station 12*d* where a second article or articles can be placed in the container. The articles can be different from one another or the same.

Alternatively, multiple loading stations can be arranged in parallel. As illustrated in FIGS. 1 and 2, loading stations 12*a* and 12*b*, which are arranged in parallel relationship, can be used at the same time for packing separate containers, or independently of one another, such that if needed or desired one loading station can be taken off line without requiring the entire system 10 to be shut down.

The article or articles 16 can be supplied for loading in the container in several ways. Before being placed in the container 20, the one or more articles 16 can be retrieved from storage and placed in a temporary receptacle (not shown), such as a tote, from which one or more articles 16 are then pulled for placement in the container 20. The articles 16 can be supplied randomly, without a predictable pattern as to which articles will be required for placing in a particular container 20, or a loading station can be dedicated to supplying one or more articles 16 based on one or more criteria. Some criteria that could be used include container dimensions, shipping company, shipping mode, article fragility, article weight, article size, article relationships, etc.

The articles 16 can be loaded into the container 20 in a variety of ways. For example, a packer can place the articles 16 in a container 20 by hand. Alternatively, the packer can initiate or otherwise control or supervise one or more steps that are performed by one or more devices that place the article or articles 16 in the container 20 (such as a pick-and-place robot (not shown), which can move an article into the container and optionally also orient the article relative to the container). Moreover, the articles 16 can be placed in the container 20 independent of any external control by an operator. In this latter example, one or more machines or other devices, controlled by the controller 26, for example, place the article or articles 16 in the container 20 without any assistance from a packer.

Transport Network

The transport network 24 transports the containers 20 between stations, typically in a downstream direction through the system 10. Any method or combination of methods of physically moving the containers 20 through the system 10 can be employed. For example, the transport network 24 can include a conveyor network that generally starts, stops, transports and orients the container 20 as needed, in which case fewer, if any, people are needed. In a highly automated system, there may only be needed one or a few people to supervise and troubleshoot transport problems for multiple lines within the network.

The transport network 24 can include multiple conveyor lines 68 that define paths through the system 10. In FIG. 1, these lines 68*a*-68*z* are shown schematically and diverge and come together to selectively route the containers along a path, such as 68*b*, 68*f*, 68*m*, 68*t* through the system 10. In FIG. 3, the transport network 24 includes a conveyor 60 such as, for example, a zero pressure accumulating conveyor. In a zero pressure accumulating conveyor, a conveyor is divided into multiple zones, each of which is sized to support at least one container. The containers move from an upstream zone to the next downstream zone as the downstream zone clears. Each zone can be powered separately, stop gates or other means can be employed to regulate the flow of containers from and within each zone, and sensors can be used to determine when a container has left a zone. A supervising controller such as controller 26 typically controls the operation of each zone.

Intermediate Stations

The optional intermediate station or stations 22 are located between the loading stations 12 and the dunnage dispensing stations 14. The intermediate stations 22 can include a void determination station or device 70 for acquiring data representative of the void volume to help the dunnage dispensing stations 14 dispense a controlled quantity of dunnage.

The void determination device 70 acquires data that can be used to determine the void volume and thereby determine how much dunnage to put into the container 20. The void volume can be determined by measuring characteristics of the container 20, the void and/or the contents directly. An exemplary void determination device is described in commonly owned U.S. Pat. No. 5,897,478, which is hereby incorporated herein by reference. The void determination device 70 in FIG. 3 includes a void volume scanner 72 having a scan area through which a container 20 can be conveyed. The void volume data obtained can be stored in an electronic storage device, which can be part of the controller 26, for example.

Optionally, the void volume can be measured by hand, using a measuring tool to measure one or more characteristics of the container. These measurements can be compared with dimensions in a look-up table to determine the void volume indirectly, or the void volume can be calculated directly from the measurements.

The void volume also can be measured with contour sensing for mapping the topography of the void volume, using electromagnetic imaging techniques and devices, such as high frequency radar, ultrasound, laser, machine vision, etc. An imaging sensor or sensors can be used to create a stereoscopic image, from which a three-dimensional model can be created for calculating the void volume.

Alternatively, a two-dimensional array of relatively movable rods can be deployed over the container to extend into the container to probe the depth. Each rod would measure the depth at its position in the array by extending downward until it encountered the top of an article 16 or a surface of the container 20. With a map of the topography, the dunnage can be directed to those areas requiring the most fill.

An exemplary void volume scanner is described in International Patent Publication No. WO 2004/041653, which is hereby incorporated herein by reference in its entirety.

Figure 6:
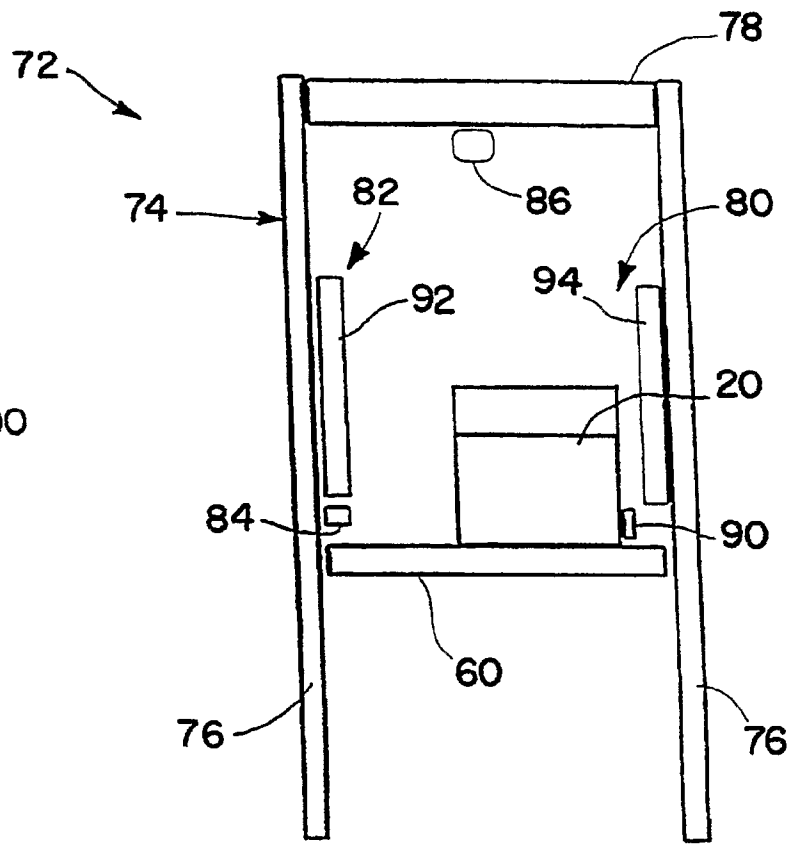
FIG. 6 is an end view of the void volume scanner of FIG. 5, looking from the line 6-6 of FIG. 5.
Figure 5:
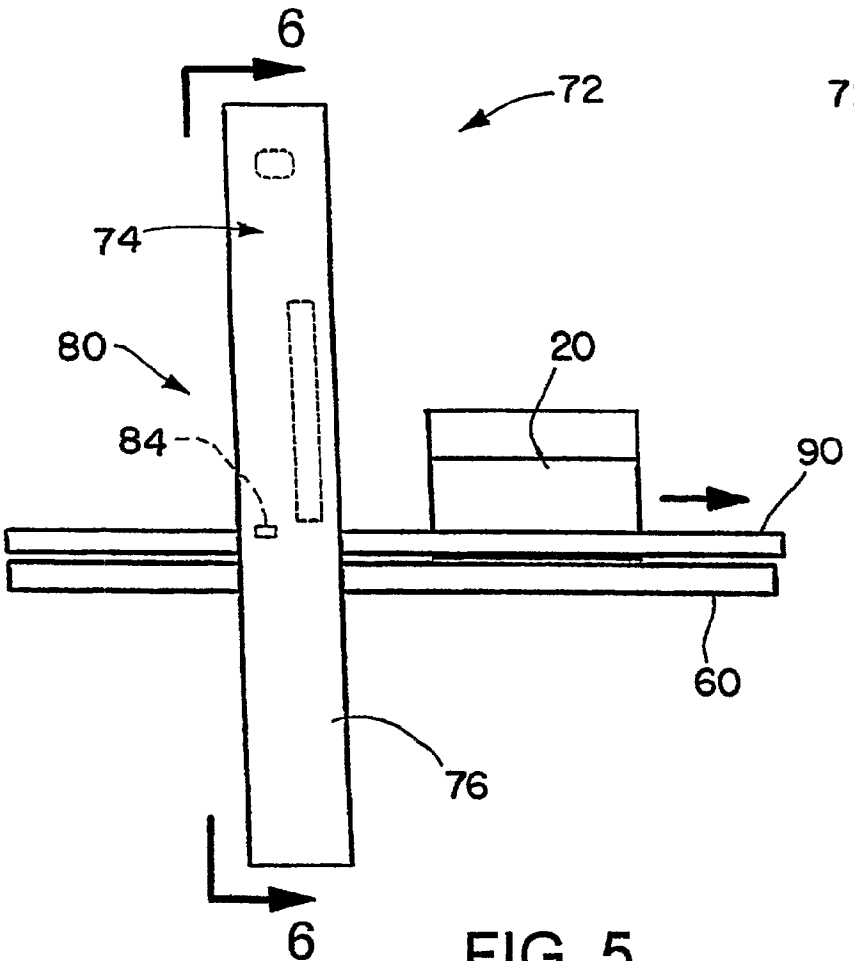
FIG. 5 is a side elevation view of a void volume scanner used in the system of FIG. 1.

In FIGS. 5 and 6, an exemplary void volume scanner 72 can be seen to include a frame 74 having a pair of uprights 76 straddling the conveyor 60 and a cross beam 78 supported atop the uprights 76 at a fixed distance from the upper surface of the conveyor 60. The uprights 76 can be floor supported, for example, or can be mounted to the conveyor 60.

The void volume scanner 72 includes one or more sensors 80, such as a weigh scale, an optical, infrared, ultrasonic, laser or other type of sensor, for obtaining data representative of the volume of the empty space or void in a container 20 in which the articles 16 have been placed for packing. In the illustrated embodiment, the sensors 80 include a height sensor 82 for providing an output representative of a height of a container 20, a width sensor 84 for providing an output representative of a width of the container 20, and a contour sensor 86 for providing an output representative of a contour of the container 20, particularly its interior and the one or more articles 16 in the container 20.

The contour sensor 86, shown mounted to the cross beam 78 above the conveyor 60, preferably but not necessarily is of a type that continuously senses the top surface of the one or more articles 16 in the container 20 as the conveyor 60 moves the container 20 therebeneath.

An exemplary contour sensor 86 is a non-contact optic laser scanner that operates by measuring the time of flight of laser light pulses, such as the Sick Optic LMS 200-30106 laser scanner. The laser scanner emits a pulsed laser beam that is reflected from the interior of the container and any articles placed therein. The reflection is registered by the laser scanner's receiver. The time between transmission and reception of the reflected impulse is directly proportional to the distance between the laser scanner and the surface from which it was reflected. The pulsed laser beam can be deflected by a rotating mirror inside the scanner so that a fan-shaped scan is made of the surrounding area, whereby the contour of the article (e.g., distance from a fixed reference point/plane) can be determined from the sequence of impulses received. The fan beam is oriented perpendicular to the movement path of the container past the sensor. Thus the contour of container 20 and the articles 16 therein passing the contour sensor 86 is progressively measured as the container 20 moves past the sensor 86.

The width sensor 84 can be any suitable sensor for determining the width of the container 20 passing thereby. In the illustrated embodiment, the width sensor 84 is an infrared distance sensor that can be used to measure the distance a first side 40*a* (FIG. 4) of the container 20 is spaced from the sensor or other reference point. In order for this embodiment to yield the width of the container, the location of an opposing side 40*b* (FIG. 4) of the container is registered at a known fixed distance from the width sensor 84 which, as shown, can be mounted to one of the uprights 76 of the scanner frame 74 at a location just above the level of the conveyor 60. To this end, the containers 20 can be registered against a guide rail 90 on the side of the conveyor 60 opposite the width sensor 84, which guide rail 90 is at a known distance from the width sensor 84 and thus functions as a zero reference. One side of the container also is oriented to be parallel the guide rail 90. Accordingly, the width of the container will be the difference between the location of the guide rail 90 and the measured location of the side of the container nearest the width sensor 84. Any suitable means can be employed to register the container against the guide rail 90 or otherwise place the container 20 in a desired consistent orientation, such as a pneumatically operated arm, a low friction surface formed by a roller conveyor, for example, inclined toward the guide rail, etc.

The height sensor 82 can be any suitable sensor for determining a height of the container 20. An exemplary sensor 82 includes an array 92 of emitters and an array 94 of receivers disposed on opposite transverse sides of the scan area. In the illustrated exemplary embodiment, the emitter and receiver arrays 92 or 94 are mounted to respective scanner frame uprights 76. Each array includes a row of emitters/receivers that is oriented perpendicular to the plane of the conveyor 60. Accordingly, the emitter array 92 produces a curtain of light that is sensed by the receiver array 94. As a container 20 moves through the curtain, the curtain will be interrupted by the container up to the height of the container, whereby a measurement of the container height can be obtained.

A separate sensor can be provided to measure the length of the container. In the illustrated embodiment, however, the container length is determined indirectly by measuring the length of time the container takes to pass any one of the sensors, such as the width sensor 84, and by knowing the speed at which the conveyor 18 moves the container past the sensor. The length of time multiplied by the speed of the conveyor 60 yields the length of the container. If the speed of the conveyor is a known constant, then only the length of time needs to be measured to determine the length of the container. If the speed of the conveyor varies, stops, starts, or for other reasons, a conveyor speed sensor can be used to measure the conveyor speed and communicate the same to the controller 26 for processing. The speed sensor, for example, can be an encoder interfaced with the conveyor drive motor for providing a series of pulses, the rate of which are proportional to the speed of the motor and thus the speed of the conveyor. The controller can be calibrated to convert the pulse rate to a container speed that can be multiplied with the time measured by the width sensor for the container to pass by the width sensor to determine the length of the container.

The void volume also can be measured without a contour sensor 86 or other methods of mapping the topography of the void volume, using such features as weight differential and volume displacement. Using the average density of shipped articles, the void volume can be calculated from the weight of the container before and after loading. The weight difference divided by the density would yield an approximate void volume. The approximate void volume would on average be accurate enough to allow automatic filling of the void from the dunnage dispensing equipment. A volume displacement technique uses the volume of fluid (such as a gas) to determine the void volume from the known empty volume of a shipping container.

Since a void determination station 70 generally can automatically provide void volume data at a faster rate than a dunnage dispenser 52 can provide dunnage for insertion into each container 20, the same void volume determination station 70 can be used to acquire void volume data that can be used to determine the amount of dunnage material to be dispensed from each multiple dunnage dispensing stations 14*e*, 14*f*, 14*g*. This can improve the throughput through the system 10, as well as increase the flexibility of the system 10 via the routing criteria.

Optionally, instead of taking measurements to determine the void volume, the void volume can be determined indirectly. For example, a sensor, such as a bar code sensor, could detect an identifier, such as a bar code, that identifies the article or multiple articles 16 and/or the container 20, and from that information a data set could be consulted that would either give their respective volumes from which the void volume can be calculated or the void volume for that particular combination of articles and container can be stored in and retrieved from the data set.

Another way to identify the container 20 and determine the void volume is by sensing one or more characteristics of the container, including container dimensions, container size, weight, etc. and looking up the void volume that most closely corresponds to the detected characteristics. For further information on an exemplary method of determining the void volume indirectly, reference can be made to International Patent Publication No. WO 98/56663, which is hereby incorporated herein by reference in its entirety.

Each container 20 and/or article 16 can include a unique identifier that can be detected by an identification sensor 100, as shown in FIG. 2. Once a particular container 20 has been assigned a unique identifier, that unique identifier can be used to associate data with that container 20 throughout the system 10, like a license plate or name tag. Separate identification sensors 100 can be used at one or more locations within the system 10, as shown in FIG. 3, and/or an identification sensor can be an integral component of the void volume scanner 72.

The identifier can take any form including a label, hardware identifiers embedded in the container, radio frequency identification (RFID) tags, colors, shapes, numbers, holes, protrusions, surface texture, patterns, dimensions of the container, thermal image, ultraviolet image, weight, electronic article surveillance (EAS) tags, etc. An EAS tag includes a microwave tag, an electromagnetic (EM) tag or an acousto-magnetic tag, for example.

The container identification sensor 100 can include an optical system to obtain an image of the container 20 or a portion thereof that can be electronically analyzed for identification. For example, a digital camera can be placed in a position that allows for a digital picture to be made of each container. The picture can then be compared to pictures of standard containers in a database. The container can be identified from its dimensions or an identifier marking such as, for example: dots, numbers, shapes, holes, color, thermal pattern, ultraviolet image, etc. The database can also provide container dimensions and empty container volume information.

Alternatively, the container identification sensor can detect radio frequency (RF) tags. An RF tag typically is associated with a container at the loading station 12 and is associated with the container throughout the packaging process. When the container is erected and dedicated to an order, an order specific RF tag is adhered to the container or placed inside the container. Order specific information (container contents, external container dimensions and empty container volume, for example) can be stored on the tag and is downloaded by an RF tag reader positioned upstream of the dunnage dispenser. The tag information is sent to an information processor that can retrieve container content information from a database. A tag retrieval station can be employed to recycle the RF tags at the end of the packaging process to make the system more cost effective. Another exemplary container identifier is a bar code. Bar code labels typically are attached to an outer surface of the container.

In some situations the void volume can be determined from the container identifier, such as when a known volume of articles is placed in a particular type of container. Once a sensor detects the container identifier, that information can be communicated to a processor having or linked to a database that provides, for example: article volume, container dimensions, void volume, empty container volume, etc. The void volume thus can be predetermined and retrievable or can be calculated from the volumes of the contents of the container and the empty container volume and/or dimensions of the container. The information can be automatically uploaded to manual, semi-automated or fully automated dunnage dispensers.

An embodiment also contemplates sequentially routing containers 20 to dunnage dispensing stations 14 without detecting an identifier for the container, either at the void determination station 70 or at the dunnage dispensing station 14, or anywhere in the system 10. Since the void determination station 70 acquires the void volume data for containers 20 provided in sequence, that data or related data representative of the amount of dunnage material to be dispensed can be communicated directly to the dunnage dispensing station 14 to which the container 20 is routed. Thus, if three containers 20*a*, 20*b*, 20*c* pass through the void determination station 70 in sequence, data can be communicated to the respective dunnage dispensing station 14 to which each container is routed without reading a bar code label on the containers. In this case, the void volume data is associated with a particular container by its place in a sequence and the routing of the container to a particular dispensing station. Consequently, container identification is effected by keeping track of where a given container has been moved in the system.

An operator can initiate or otherwise control one or more steps that are performed by one or more devices that determine the required quantity of dunnage. Alternatively, the void volume can be determined automatically, without external intervention or control by a person. As is apparent from the above description, however, the intermediate stations are not always needed. In some situations the void volume does not have to be determined. For example, the void volume can be filled until the container is full. The system 10 simply needs to know when to stop filling the container 20, using sensors, backpressure or mechanical resistance.

In one known method, for example, an airbag is inflated within a container until the walls of the container move outward, which indicates that the container is full.

As yet another alternative for instances where the void volume does not need to be determined, the container 20 can be deliberately overfilled and the excess dunnage removed to obtain the desired degree of fill. The excess dunnage removed can be returned to the supply thereof. The amount of dunnage dispensed can be predetermined based on the volume of the largest potential container, or can be guided by one or more sensors. For example, a container can be transported under a continuous waterfall of flowable dunnage at a rate sufficient to allow the largest anticipated void to be filled, and then any excess dunnage can be removed and recycled through a recycling hopper and transported back into a fill hopper, for example, along with any overflow.

In this case, the void volume around the articles in the container does not have to be determined. A swiping or blow-off apparatus can be employed to remove excess dunnage at the top of the container. In this system, RSC flaps must be in the down position, folded outside the container, or a shoe box-style container must be employed. In the case of an RSC, flap handling equipment must be employed to prepare the container for filling and to raise the flaps again for sealing the container, i.e. to move the flaps up and down as needed.

Another type of intermediate station 22, is a go/no go station for determining whether a container conforms to predetermined criteria. The predetermined criteria can include factors that makes the container suitable for receiving dunnage and/or that would prevent the container from closing properly, for example. The functions of the go/no go station optionally can be performed by a void volume scanner 70 or other component of the system 10. Thus the go/no go station can be its own intermediate station, or part of one or more of the other stations. For example, the void determination station 70 also can include one or more sensors used to determine whether the container is suitable for receipt of dunnage, i.e., whether a non-conforming fault condition exists.

One or more fault conditions could make the container unsuitable for receiving dunnage, in which case a nonconforming container requires special processing. Special processing can include repositioning an article in a container, manually dispensing the desired amount of dunnage and placing it in the void in the container and/or reintroducing the container to the transport network 24 after resolving the nonconforming fault condition. The controller 26 can provide a signal to alert an operator to the existence of nonconforming fault conditions for which an operator's attention is desired before the container can continue. Additionally or alternatively, upon detecting one of these or other fault conditions where a container falls outside acceptable operating criteria, the controller 26 can automatically route the container to a separate conveyor for special processing by an operator.

Nonconforming fault conditions include, for example, an indication that no container is detected, a flap of a container partially or completely blocks the opening into a container, one or more measured container dimensions is below minimum and/or above maximum thresholds, container weight is below a minimum and/or above a maximum threshold, a void volume equal to the container volume (which would indicate that there is no article in the container) or exceeds container volume (which can indicate that the container is overfull), weight (empty or overweight), conditions that would prevent the container from closing properly, such as articles-extending above a certain height, etc. A nonconforming fault condition also can indicate a situation that fails to meet other predetermined criteria, such as a narrow but deep void volume, that might require special processing by an operator.

Controller

As above mentioned, the controller 26 functions to control one or more components of the system 10. For example, the controller 26 can route containers 20 along the transport network 24 from the loading stations 12 to the dunnage dispensing stations 14, as well as the void determination stations 70 when included, and/or controllably dispense dunnage material for placement in the void volume. In addition, optionally the controller 26 can track containers 20 through the system 10.

The various functions of the controller 26 can be performed by a single processor unit, such as a control unit for the void determination stations 70, or the functions can be distributed among several processor units, each having separate processors, such as among a control unit for one or more void determination stations 70, one or more control units for the dunnage dispensing stations 14, a separate (possibly remotely located) microprocessor of a personal computer, or combinations thereof.

The controller 26 can be any one of a number of commercially available processors or combinations thereof, such as programmable logic controllers (PLCs) and general purpose processing chips with various output and input ports and associated electronic data storage devices including read-only memory (ROM) and random-access memory (RAM). The controller 26 also can provide wireless communications capabilities, including cellular, infrared, wireless modem, microwave, radio frequency, satellite communications technology, etc., for remote control, data transfer and other communications purposes. The communications can be one-way or two-way. Wireless communications can be advantageous for remote control, monitoring and diagnostics; updating software; and eliminating or minimizing wiring to and from the system, as but a few examples. The controller 26 can be controlled by suitable software that among other things uses data received from the scanning sensors to determine container length, width, height and interior contour, and thus the void volume, as well as determining the amount of dunnage material to be dispensed for insertion into that volume, the type of dunnage material to be dispensed and/or the speed at which the dunnage material is dispensed.

The controller 26 can be equipped with various ports (not shown) for connection with various elements of the system 10, including input devices, such as a foot switch 110 for the dunnage converter 52, a conveyor speed sensor 112, a mouse, a keyboard, a keypad, a touch screen, etc.; and output devices such as an operator panel, a display 114 for the dunnage converter 52, a nonconforming container indicator (not shown), a container sensor (not shown), etc.

For example, an operator panel 114 (FIG. 3) for the dunnage converter 52 can be equipped with a touch screen as an input device, or a personal computer can have a touch screen or other input device associated therewith. The operator panel 114 and/or controller 26 can have a monitor for displaying the various indicators and/or other information, such as the measured dimension of the container 20, the total volume of the container 20, the volume of the contents of the container 20, an identification of the container 20 and the volume of the void above the container contents 16, etc.

Additionally, the operator panel 114 and/or controller 26 can be provided with a selector device enabling the selection of a void-fill density from a plurality of void-fill densities. The selector device is an input device, and can include a dial whereby a desired density can be dialed in, a mouse pointer, a touch screen with one or more input regions, a keyboard or keypad for entry of a desired void-fill density, a foot switch, etc. In accordance with the selected void-fill density, the controller can vary the amount of dunnage material to be dispensed per measured volume of void, thereby to provide the selected void-fill density. That is, the controller can be programmed to have a default setting where it will command a predetermined amount of dunnage to be dispensed for each unit volume of measured void. If minimal protection is needed, for example, the operator can select a lower void-fill density and the controller will command, for example, 10% less dunnage material to be dispensed per given unit of measured top-fill void. This will result in a lower density fill of the container 20 and will consume a smaller quantity of dunnage material. On the other hand, if greater protection is needed and/or the articles packed in the container 20 are heavier, the operator can select a higher void-fill density and the controller 26 will command, for example, 10% more dunnage material to be dispensed per given unit of measured top-fill void. The containers 20 cannot only be filled with different densities of dunnage, but different densities can be provided to different segments of the void volume, so that more or less dunnage can be provided to different volume segments of the container.

Additionally or alternatively, the controller 26 can be programmed to select a density and/or a dunnage fill speed based on shipping criteria. The shipping criteria can be provided by a label, a bar code, or other features of the container and/or the articles packaged therein. Some examples of shipping criteria include void volume, container size, container weight, a specified transportation company, a specified mode of transport (water, land or air transport, for example; or truck or train transport; or local or long distance transport; etc.), features of the article (oversize, fragility, etc.), type of dunnage material being used (closed-cell foam, expanding foam, air pillows, paper dunnage, flowable dunnage, etc.) or combinations thereof. The invention is not limited to the listed shipping criteria. As noted, these are but a few general examples of potential shipping criteria.

The controller 26 also can record the amount of dunnage dispensed by the dunnage dispensers and other events, such as when the instructions to a dispenser were overridden by an operator to provide more or less dunnage to a container, in addition to tracking the shipping criteria and other data. This information can be used to improve the system over time either manually or automatically, identify packaging trends, and identify maintenance needs. For example, if under particular shipping criteria an operator frequently manually overrides the dunnage dispensing instructions and dispenses additional dunnage, then the instructions for the shipping criteria can be automatically updated to instruct a dispenser to dispense additional dunnage for that shipping criteria. As another example, if a small number of the available dunnage dispensers are used for a particular shipping criteria and that shipping criteria is being applied more frequently, then the controller 26 might generate a report with an indication that additional dispensers need to be assigned to that shipping criteria.

Figure 7:
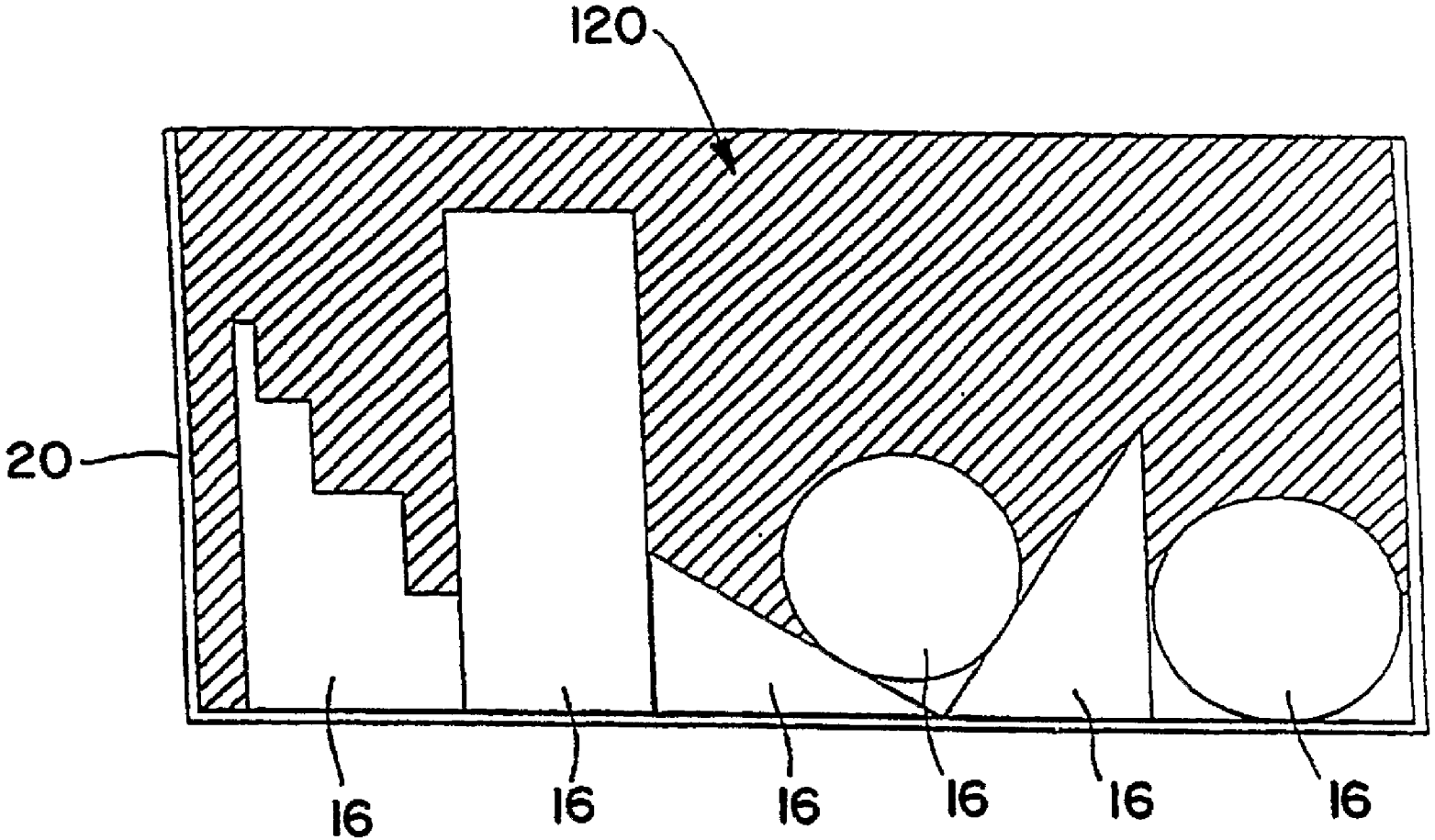
FIG. 7 is a cross-sectional view of a container in which several articles have been placed, with the remaining void being denoted by cross-hatching.

In one embodiment, the controller 26 is operable to process the void volume data acquired by the void determination stations 70. The controller 26 then determines the amount of dunnage material needed to place in the void left in the container 20 when the one or more articles 16 have been placed in the container (or the bottom wall of the container if not overlain by an article). In FIG. 7, this void 120 is illustrated by the cross-hatching. After the void volume is determined, the controller can command the dunnage dispensing station 14 to dispense the determined amount of dunnage. The dunnage can flow directly into the container 20 and/or be placed or guided into the container 20 by an operator.

Dunnage Dispensing Stations

At the dunnage dispensing stations 14 a controlled amount of dunnage is dispensed and placed in the void 120 (FIG. 7) in the container 20 around the article or multiple articles 16 to minimize or prevent the articles from shifting during transport and to protect them from damage. Each dunnage station 14 includes or is connected to a supply of dunnage. An exemplary dunnage dispensing station is shown in International Patent Application Publication No. WO 2003/089163, which is incorporated herein by reference. The present invention contemplates use of any type of dunnage dispensing device or means.

The containers 20 can be delivered to a dunnage dispensing station 14 randomly, or based on one or more routing criteria. Exemplary routing criteria include container size, container weight, packing priority, shipping destination, dunnage type, mode of shipment, shipping company, void geometry, void volume density, article fragility, dunnage dispensing station availability, etc.

As with the loading stations 12, and as shown in FIG. 1, in an embodiment the dunnage dispensing stations 14 can be arranged in series, such as, for example, dunnage dispensing stations 14*f* and 14*g*. With such an arrangement multiple in line stations can supply dunnage to a container sequentially, such as for dispensing one or more types of dunnage, one or more quantities of dunnage, dunnage to a batch of containers simultaneously and/or one or more densities of dunnage, for example.

Optionally the dunnage dispensing stations 14 can be arranged in parallel, such as, for example, dunnage dispensing stations 14*a*-14*e*. With such an arrangement, dunnage can be dispensed for multiple containers substantially simultaneously (i.e., at about the same time) and independently of one another such that, for example, a dunnage dispensing station 14 can be taken off line for maintenance or for refilling without impacting the entire system. Optionally each of these dunnage dispensing stations 14 can be dedicated to a particular container 20 based on routing criteria, as discussed below.

The dunnage dispensing stations 14 can each supply a single type or multiple types of dunnage, or respective stations can provide dunnage having one or more different characteristics. For example, the containers 20 can be filled with different densities of dunnage, including different densities in different areas of a single container. If the topography, geometry or contour of a surface of the void volume is known, more or less dunnage can be provided to different areas according to that known information.

The supply of dunnage at each station 14 can include a dunnage dispenser, such as a hopper or other storage container. Additionally or alternatively, the dunnage dispenser can be a dunnage converter 52 as shown in FIG. 3, for converting a stock material into a relatively less dense dunnage product. The dunnage can be provided in a common supply for multiple dunnage dispensers or each dispensing station 14 can have its own supply.

In the case of a dunnage converter 52, the dunnage can be produced on site, since a dunnage converter 52 and the stock material together typically occupy less space than an equivalent stored volume of dunnage material. The dunnage dispenser also can include any type of suitable mechanism for moving the dunnage toward or into the container, including mechanical feeding or transporting mechanisms (such as a conveyor, pusher, screw, roller, movable support, etc.), pneumatic or electromagnetically powered devices, or even gravity.

Dunnage

Suitable dunnage includes any material that can be placed in the void in the container 20. Several examples of different types of dunnage include continuous strip dunnage, discrete pad-like dunnage, expandable dunnage, and flowable dunnage.

A continuous dunnage strip or strips can be used to fill the void volume. Exemplary dunnage of this type includes paper, typically crumpled or otherwise formed into a three-dimensional shape that takes up a greater volume than the area and thickness of the stock material; a strip of soft or rigid foam having a predetermined width and/or either a predetermined length or a variable length; a strip of air bags; an air bag "tube" having a predetermined cross-sectional area that can be formed in a range of lengths; a strip of bubble pack, typically formed from a pair of plastic sheets affixed to each other to entrain pockets of air "bubbles" between the sheets; an extruded-in-place strip or tube of foam that forms as it is dispensed from an outlet; and linked dunnage, such as chains of linked dunnage segments or sausage links. With respect to paper dunnage, optionally the paper can be formed into a strip.

Linked dunnage includes relatively low density portions connected by a higher density material, and generally can occupy a greater volume than a similar size and number of unconnected low density dunnage portions. Linked dunnage includes, for example, connected air bags, with lower density portions connected by higher density portions, etc.

The continuous strips of dunnage can be fed directly into the void in a container using a chute with rotating members to "shoot" the strip into the container or into an intermediate chamber or other holding location from which the strip can be pushed, dropped or otherwise moved into the container. The strips also could be wound into a coil and then sections can be withdrawn from the coil as needed.

Dunnage segments or discrete dunnage units are sections of dunnage. Typically, when using discrete pad-like dunnage, one or more dunnage pads having one common length or different lengths are placed in the void volume. Otherwise, the pad-like dunnage can be similar in shape to respective dunnage strips described above. Exemplary dunnage pads include paper pads formed, for example, by crumpling or otherwise forming a paper sheet or sheets into a three-dimensional shape that takes up a greater volume than the area and thickness of the stock material; discrete or connected sections of soft or rigid foam; air bags having a predetermined size and shape; air bag "tubes" having a predetermined cross-sectional area that can be formed in predetermined lengths; and sheets of bubble pack of predetermined lengths, etc. Optionally the paper can be coated to increase its mass; and/or portions of the paper can be cut or otherwise removed to reduce its mass.

Discrete pad-like dunnage can be oriented and placed in a container by a pick-and-place robot, pushed into a container from a holding location or dropped or otherwise fed into the container directly from a hopper or dunnage conversion machine. An exemplary pad-producing dunnage dispenser, such as is disclosed in U.S. Pat. No. 5,123,889, for example, can convert one or more plies of sheet stock material (such as kraft paper) into a relatively less dense dunnage material.

Expandable dunnage expands to fill a range of volumes. Some examples of expandable dunnage include: foam-in-a-bag, where the chemical components of a foam are placed in a sealed bag, typically made of some type of polymer suitable for controlled activation; and inflate-in-place air pillows that can be inflated inside the container to fill the void volume, as described in U.S. Pat. No. 6,253,806, for example. In foam-in-a-bag dunnage, the foam expands within the bag to fill an enclosed volume, either the bag itself or the void in a closed volume. The expanded foam solidifies in a shape that approximates the shape of the void volume. The bag can be placed in the container, which is then closed and the foam fills the closed volume, or, particularly when the shape of the void volume is known, the foam-in-a-bag can be solidified in a mold having the desired shape before it is placed in the container.

Flowable dunnage includes a plurality of relatively small dunnage products that can flow into the void in the container. Some examples of flowable dunnage include: foam "peanuts," paper peanuts, air bag "ravioli" formed of small air bags, etc.

The flowable dunnage product can include multiple sizes within the supply. Flowable dunnage typically is dispensed first to a hopper for storage, and then fed through tubes or chutes into the container. One exemplary flowable dunnage dispenser is disclosed in U.S. Pat. No. 6,672,037. A vibration table also can be used to ensure that the flowable dunnage settles into the void volume in the container.

The type of dunnage dispenser or converter 52 employed typically will be dunnage-dependent. For each dunnage product there can be multiple ways to deliver and place the dunnage in the container 20 other than the exemplary methods described herein. The dunnage dispenser 52 also can include self-limiting features that stop delivery of the dunnage once a sensor is triggered, such as an electromagnetic sensor, mechanical trigger or backpressure sensor. For example, a limiting plate with a passage therethrough can be placed over the opening in a container, and a gate valve, butterfly valve or other valve can be used to allow flowable dunnage to pass through the limiting plate. The plate effectively closes the top of the container, but allows the dunnage to fill the container until one or more sensors are triggered to indicate that the container is full. One example is disclosed in U.S. Provisional Patent Application No. 60/624,348, filed Nov. 2, 2004, which is hereby incorporated herein by reference in its entirety.

The dunnage supplied at each dunnage dispensing station 14 can be placed in the container 20 entirely by hand; or the dunnage can be placed by a packer initiating or otherwise controlling one or more steps that are performed by one or more devices that place the dunnage in the container 20 (such as a pick-and-place robot). As another alternative, the dunnage can be placed in the container independent of any external control. In this latter example, one or more devices, controlled by the controller 26, for example, automatically place the dunnage in the void volume in the container 20 without any assistance from a packer.

Container Closing Station

The container closing station 102 is where the container is closed and prepared for shipping. After dispensing the dunnage, the container 20 is transferred to a container closing station 102 to close the container 20. Devices for automatically closing a container 20, typically referred to as "box closers," are known and can be used in the final step of the packing process to automatically close and seal the container for shipment. In the case of a RSC container, the container 20 can be automatically sealed using automatic flap folding equipment integral to or ancillary to an automatic box sealing device, including but not limited to random case sealers, tapers, and strapping equipment. If a shoe box-style container 20 is used, the container 20 is sealed using hot glue or strapping equipment that secures a separate lid on the container, using hot glue, tape or straps, for example, to close the container 20 and secure it for shipping. Shipping labels also can be applied automatically, meaning than in many instances the operator's involvement in the packaging process can be minimal or nonexistent, freeing the operator to deal with nonconforming fault conditions and/or placing articles in more containers.

Alternatively, the packer can close and seal the container 20 using tape, straps, or an adhesive. Alternatively, the packer performs some steps, such as folding flaps down or placing the lid on the container, and other steps are performed by a container closing mechanism. Finally, the container 20 is routed to a shipping station 104. There the containers 20 can be sorted by destination, mode of transport, etc. and further bundled for shipment, if necessary.

Exemplary Method of Operation

Figure 8:
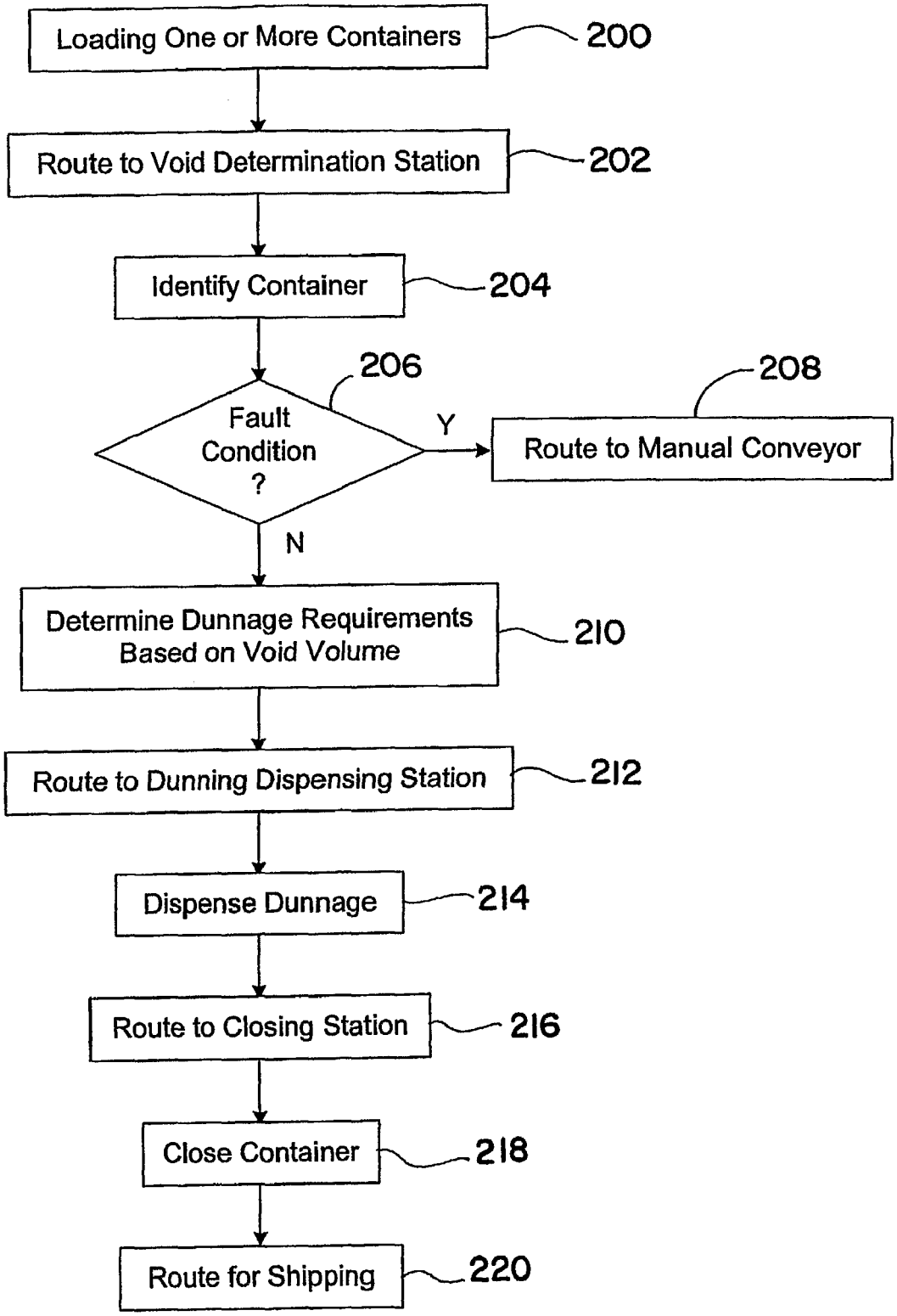
FIG. 8 is a flowchart illustrating a packaging process in accordance with an embodiment of the invention.

FIG. 8 illustrates an exemplary methodology for an automated packaging system. The steps or blocks shown represent functions, actions or events performed. If embodied in software, each block may represent a module, segment or portion of code that comprises one or more executable instructions to implement the specified logical function(s). If embodied in hardware, each block may represent one or more circuits or other electronic devices to implement the specified logical function(s). Computer software applications generally involve dynamic and flexible processes such that the functions, actions or events performed by the software and/or the hardware can be performed in other sequences different than the one shown.

With reference to FIGS. 3 and 8, an exemplary system can operate in the following manner. One or more containers 20 are erected by a container erector 32 at one of one or more loading stations 12 where one or more articles 16 subsequently are placed in the container for shipping at step 200. The container 20 is then routed in step 202 to a selected one of a plurality of void determination stations 70 for determining the void volume, if the void volume is needed. This step is not always necessary and in some cases can be omitted, as previously mentioned. A container identifier also can be detected at step 204, if required. The container 20 is examined for suitability for receiving dunnage, i.e. for a fault condition, at step 206. If a nonconforming fault condition exists the container 20 can be diverted for special handling by an operator in step 208. If there is no nonconforming fault condition, the dunnage requirements for the void volume are determined at step 210. The container 20 is routed to a selected one of a plurality of dunnage dispensing stations 14 in step 212 where dunnage is dispensed and placed in the void volume in step 214.

A prescribed amount of dunnage can be dispensed automatically, based on the determined void volume. The container 20 can be automatically positioned at the outlet of a dunnage dispenser 14*a* and dunnage can be dispensed automatically, directly into the container 20, without intervention by an operator, or the dunnage can be dispensed automatically but not directly into the container 20 or can be dispensed under the direction of an operator for subsequent placement in the container 20. After the prescribed amount of dunnage material has been dispensed and either dispensed directly into the container 20 or placed in the container 20 in a subsequent step, the container 20 can be passed on for further processing, such as routing the container 20 through a container closer at the container closing station 130 in step 216 and closing the container 20 in step 218 and then routing the container 20 through a shipping station 132 at step 220 for further transport to a remote location.

Returning now to FIG. 2, this figure illustrates an exemplary embodiment of a packaging system 300. The system 300 includes a plurality of loading stations 12*a*, 22*b*; a transport network 24 having a plurality of transport lines 68*b*, 68*c*, 68*f*, 68*g*, 68*h*, 68*m*, 68*n*, 68*o*, and 68*t*, for example; a container diverter 301; diverter lines 68*aa*, 68*bb*, 68*cc*; router gates 302*a* and 302*b*; an intermediate station 22*a*; and dunnage dispensing stations 14*a*, 14*b*, 14*c*, and 14*d*. During normal operation, articles (not shown) are placed in containers 20 at parallel loading stations 12*a* and 12*b*. The articles may be placed in the containers manually or via an automated system. The containers 20 travel to an intermediate station 22*a* via either transport lines 68*b* or 68*c*, or a combination thereof.

The transport lines 68 are illustrated as multiple conveyers, i.e. transport lines 68*b*, 68*c*, 68*f*, 68*g*, 68*h*, 68*m*, 68*n*, 68*o*, and 68*t*, etc. The transport network 24 can include any means, however, for transporting the containers 20 between two or more stations, such as, for example: one or more conveyers, which may be driven by motors, gravity, pneumatically, manually; one or more chutes; etc. In addition, the transport network 24 can include any combination of the different types of transport lines. Moreover, the length of each transport line 68 generally is dependent on the distances between the stations. In some embodiments, the sensors or components described herein with respect to different or separated stations may be integrated into a single station. For example, a sensor for determining whether the container should be automatically filled with dunnage has been described with respect to an intermediate station, but could be integrated into the loading stations 12*a* and 12*b*, or integrated into the dispensing stations 14*a*, 14*b* and 14*c*. In such a case, the transport line between the sensor and the station can be very short, such as, for example, less than a foot.

At intermediate station 22*a* data or information regarding the container 20 and/or its contents is obtained. The data is obtained via one or more sensors (not shown) and the data can include, for example, the topography of the contents of the container 20, the size of the container 20, the location of the contents, etc. A controller 26 determines whether the loaded container 20 is suitable for automatic dunnage insertion as a function of the data obtained at intermediate station 22*a*. If the loaded container 20 is not suitable for automatic dunnage insertion, for example, if the contents of the container 20 are above the top of the container 20, the container 20 is moved to diverter line 68*aa*, by the container diverter 301. In one embodiment, the container diverter 301 is a pneumatically-operated piston that pushes the container 20 onto diverter line 68*aa*. The container diverter 301 can include any means for diverting the container 20 to the diverter line 68*aa*, such as, for example, a switching bar, a trap door, a pick-and-place robot, etc. In another embodiment, the container diverter 301 does not physically remove the container 20 from the transport lines leading to the dunnage dispensing stations 14. Instead, the controller 24, instructs the dispensing stations 14 to allow the container to pass through the dispensing station 14 without inserting dunnage into the container 20, thereby indirectly removing the container 20 from the transport line. In this case, the container 20 optionally can be removed from the system after it passes the dunnage dispensers 14.

Returning to the illustrated embodiment, the diverter line 68*aa* is a means for physically removing the container 20 from the transport line leading to the automatic dunnage dispensers 14*a*, 14*b* and 14*c*. Optionally, the diverter line 68*aa* can include a transport line to a diversion station 14*d* where the non-conforming condition can be resolved. Dunnage can be placed in the container at the diversion station 14*d*, or the container 20 can then be reintroduced to a transport line 68*f*, 68*g* or 68*h* leading to the automatic dunnage dispensing stations 14*a*, 14*b* and 14*c*, or can be transported to a dunnage dispensing station (not shown) outside of the transport network 24.

If a container 20 is suitable for packing (e.g., there is no non-conforming fault condition), the controller 26 can control a series of router gates 302*a* and 302*b* that are controllably opened and closed by the controller 26 to direct the container to a selected dunnage dispensing station 14. The first router gate 302*a* is used to route the container 20 to either dunnage dispensing station 14*a* or on toward the second router gate 302*b* and dunnage dispensing stations 14*b* and 14*c*. The router gates 302*a* and 302*b* each include respective pneumatically-operated swing arms 304*a* and 304*b*. If the first swing arm 304*a* is activated or otherwise placed in a closed condition, the container 20 is routed to a first transport line 68*f* and to automatic dunnage dispenser 14*a*. If the first swing arm 304*a* is open and the second swing arm 304*b* is activated or otherwise placed in a closed position, the container 20 is routed to transport line 68*g* and to automatic dunnage dispensing station 14*b*. Otherwise, if both swing arms 304*a* and 304*b* are open, the container will be directed to transport line 68*h* and to automatic dunnage dispensing station 14*c*. The router gates 302*a* and 302*b* can include any means of routing the container 20 to a selected automatic dunnage dispensing station 14*a*, 14*b*, or 14*c* such as, for example, a single arm, a robotic arm, a bush bar, a rotating table, a plate, etc.

The controller 26 determines the volume of dunnage to be placed in the container 20 as a function of the data obtained at intermediate station 22*a*. The controller 26 provides a signal to the selected dunnage dispensing station 14*a*, 14*b* or 814*c*. The controller 26 thus instructs the dunnage dispenser, such as a dunnage converter (not shown), to dispense the required volume of dunnage. At automatic dunnage dispensing stations 14*a*, 14*b* and 14*c* the container 20 is automatically filled with the determined volume of dunnage.

From dunnage dispensing station 14*a*, the container 20 moves on transport line 68*m* to a closing station 102*a*, where the container is closed, and then on to a shipping station 104*a* via transport line 68*t*. From dunnage dispensing stations 14*b* and 14*c*, respective transport lines 68*n* and 68*o* transport containers to a shared closing station 102*b*. In the illustrated embodiment, the diversion dunnage dispensing station 14*d* transports a container to a closing station 102*c* via transport line 68*bb* and then transport line 68*cc* transports the container to a shipping station 104*b* that is shared with automatic dunnage dispensing stations 14*b* and 14*c*.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed is:

1. A packaging system, comprising at least two dunnage dispensing stations, each of which has at least one dunnage dispenser from which a dunnage material can be dispensed; and a transport network for conveying containers to and from the at least two dunnage dispensing stations for dunnage to be placed therein, wherein the transport network includes at least two paths, each of which includes at least one dunnage dispensing station, and wherein the transport network includes a mechanism for selectively routing each container along a respective path to a particular dispensing station based on a characteristic of the container.

2. A packaging system as set forth in claim 1, wherein the mechanism includes a sensor for identifying a characteristic of the container.

3. A packaging system as set forth in claim 1, wherein the dunnage dispenser includes a dunnage conversion machine that can convert a stock material into a relatively less dense dunnage material.

4. A packaging system as set forth in claim 1, wherein the dunnage dispenser includes a supply of dunnage having at least one of air bags, crumpled paper, foam strips, foam peanuts, and paper strips.

5. A packaging system as set forth in claim 1, comprising one or more loading stations upstream of at least one dunnage dispensing station where one or more articles are placed in one or more containers for transport.

6. A packaging system as set forth in claim 1, including an intermediate station upstream of at least one dunnage dispensing station that includes a sensor for sensing a characteristic of the void volume in the container.

7. A packaging system as set forth in claim 1, including an intermediate station upstream of at least one dunnage dispensing station that includes at least one device for determining whether the container conforms to predetermined criteria.

8. A packaging system as set forth in claim 7, wherein the transport network includes a way to divert nonconforming containers that fail to meet the predetermined criteria.

9. A packaging method, comprising the following steps:

routing a container along a path to a dunnage dispensing station selected from multiple paths, each of which includes a dunnage dispensing station, based on routing criteria that includes a characteristic of the container; and supplying dunnage to the container at the dunnage dispensing station.

10. A method as set forth in claim 9, wherein the routing step includes routing based on routing criteria that includes one or more of characteristics of the dunnage material, characteristics of the void in the container, and characteristics of the article to be shipped in the container.

11. A method as set forth in claim 9, wherein the routing step includes determining the type of dunnage to be dispensed.

12. A method as set forth in claim 9, including the step of determining the void volume in the container.

13. A method as set forth in claim 12, wherein the supplying step includes dispensing dunnage material based on the void volume of the container.

14. A method as set forth in claim 9, including the steps of assigning an identifier to each container and tracking the container as it moves through the packaging system.

15. A method as set forth in claim 9, including the step of diverting containers that do not conform to predetermined criteria.

16. A packaging system, comprising one or more void sensing stations that sense characteristics of a void volume of a container; a plurality of dunnage dispensing stations that can dispense dunnage material based on the sensed characteristics of the void sensing stations; and a transport network for moving the container along a path from one of the void sensing stations to a selected one of the dunnage dispensing stations based on the sensed characteristics, wherein the transport network includes multiple paths and each path includes a respective dunnage dispensing station.

17. An automated packaging system for filling the void in a container comprising:

a plurality of loading stations for loading containers;

a plurality of dunnage dispensing stations;

a transport network linking the loading stations to the plurality of dunnage dispensing stations for transporting the containers from the plurality of loading stations to one or more dunnage dispensing stations, where the transport network includes a plurality of paths, and each path includes a dunnage dispensing station;

a controller; and a void volume detection device upstream of at least one dispensing station for obtaining information indicative of the void volume in the container and providing the obtained information to the controller, wherein the controller automatically routes containers via respective paths in the transport network to selected dunnage dispensing stations based on the obtained information.

18. A system as set forth in claim 17, wherein the controller determines a volume of dunnage to be dispensed at a dunnage dispensing station as a function of the information indicative of the void volume and directs a dunnage dispensing station to automatically dispense the determined volume of dunnage.

19. An automated system for packaging articles in a container comprising:

a loading station for loading one or more articles in a container;

means for identifying a characteristic of the container;

means for determining a volume of dunnage to dispense into the container;

a plurality of dunnage dispensers, each of which lies on a respective one of multiple paths from the determining means; and means for routing the container on a respective path from the loading station to a selected one of the plurality of dunnage dispensers based on identified characteristics of the containers;

wherein the selected dunnage dispenser provides the determined volume of dunnage into the container.

20. An automated system as set forth in claim 19, comprising means for determining that the container is not suitable for automatic filling of dunnage as a function of the identified characteristic.

* * * * *